US008376185B2

(12) United States Patent
Liebal et al.

(10) Patent No.: US 8,376,185 B2
(45) Date of Patent: Feb. 19, 2013

(54) SYSTEM AND METHOD FOR FRAUD DETECTION AND SHUT-OFF AT A FUEL DISPENSER

(75) Inventors: Michael Liebal, Greensboro, NC (US); Paul Kaper, Bermuda Run, NC (US); Chris Scott, High Point, NC (US); Brent K. Price, Winston-Salem, NC (US)

(73) Assignee: Gilbarco Inc., Greensboro, NC (US)

( * ) Notice: Subject to any disclaimer, the term of this patent is extended or adjusted under 35 U.S.C. 154(b) by 576 days.

(21) Appl. No.: 12/536,187

(22) Filed: Aug. 5, 2009

(65) Prior Publication Data

US 2011/0031267 A1 Feb. 10, 2011

(51) Int. Cl.
*B67D 1/00* (2006.01)
*B67D 7/16* (2010.01)
*B67B 7/00* (2006.01)

(52) U.S. Cl. ..... 222/59; 222/1; 222/71; 222/14; 137/1

(58) Field of Classification Search ..... 222/14, 222/23, 52, 59, 63, 71; 137/1, 565.16, 565.17; 73/40, 40.5 R, 861.75, 861.79
See application file for complete search history.

(56) References Cited

U.S. PATENT DOCUMENTS 4,397,405 A * 8/1983 Batson ..... 222/14
4,662,539 A * 5/1987 Komukai ..... 222/14
4,726,492 A * 2/1988 Komukai ..... 222/14
5,056,017 A 10/1991 McGarvey
5,257,720 A * 11/1993 Wulc et al. ..... 222/20
5,303,842 A * 4/1994 Harp et al. ..... 220/562
5,317,899 A * 6/1994 Hutchinson et al. ..... 73/40.5 R
5,325,706 A * 7/1994 Grose ..... 73/40.5 R
5,527,130 A 6/1996 Webb
5,734,851 A * 3/1998 Leatherman et al. ..... 715/771
5,794,667 A * 8/1998 Payne et al. ..... 141/128
5,975,353 A 11/1999 Finlayson
6,227,409 B1 * 5/2001 Brown ..... 222/1
6,253,779 B1 7/2001 Nanaji et al.
6,352,176 B1 * 3/2002 Hartsell et al. ..... 222/1
6,522,947 B1 2/2003 Hartsell, Jr.
6,745,104 B1 6/2004 Dickson
6,763,974 B1 7/2004 Shermer et al.
6,929,018 B2 * 8/2005 Shepard et al. ..... 137/1
(Continued)

FOREIGN PATENT DOCUMENTS

EP 0584924 A1 3/1994

OTHER PUBLICATIONS

PCT International Search Report dated Sep. 22, 2010.

(Continued)

*Primary Examiner* — Paul R Durand
*Assistant Examiner* — Nicholas J Weiss
(74) *Attorney, Agent, or Firm* — Nelson Mullins Riley Scarborough LLP

(57) ABSTRACT

A system and method of detecting fuel theft at a fuel dispenser. The dispenser has a primary flow meter, an auxiliary flow detection device positioned at an entrance of a dispenser, and an auxiliary dispenser shutoff system. A rate of flow through the primary flow meter and a rate of flow through the auxiliary flow detection device are calculated. The primary flow meter rate of flow and the auxiliary flow detection device rate of flow are compared. If the difference exceeds a threshold, a shutoff signal is provided to the auxiliary dispenser shutoff system to stop fuel flow through the dispenser.

22 Claims, 5 Drawing Sheets

U.S. PATENT DOCUMENTS

| | | | | |
|---|---|---|---|---|
| 6,935,356 | B2 | 8/2005 | Shepard et al. | |
| 7,028,561 | B2 * | 4/2006 | Robertson et al. | 73/861.79 |
| 7,555,935 | B2 | 7/2009 | Baillargeon et al. | |
| 2004/0088122 | A1 * | 5/2004 | Nanaji et al. | 702/45 |
| 2004/0187933 | A1 | 9/2004 | Shepard et al. | |
| 2005/0126307 | A1 | 6/2005 | Robertson et al. | |
| 2006/0260680 | A1 | 11/2006 | Reid et al. | |
| 2011/0040503 | A1 * | 2/2011 | Rogers et al. | 702/55 |

OTHER PUBLICATIONS

PCT Written Opinion dated Sep. 22, 2010.

* cited by examiner

SYSTEM AND METHOD FOR FRAUD DETECTION AND SHUT-OFF AT A FUEL DISPENSER

FIELD OF THE INVENTION

The present invention relates to the art of fuel dispensers. More particularly, the present invention relates to the detection of and response to fuel theft at a fuel dispenser.

BACKGROUND OF THE INVENTION

As fuel prices continue to rise, small businesses and global enterprises find themselves paying more for nearly every input and service needed to bring their products and services to market. Consumers have had to adjust because they must pay more at the grocery store, shopping malls, and to fill up their tanks. Moreover, as fuel prices continue to rise, the incentive to steal fuel becomes greater. In regions of the United States, for example, fuel theft has become a significant cost to station owners. Station owners are demanding solutions to gaps in security that exist in dispensers.

The dispenser security gaps are not due to negligence on behalf of manufacturers, but rather to key differences in customer requirements for dispenser design. When fuel prices were much less, say $1.00/gal, the incentive to steal fuel was not as strong as it is when prices are above $4.00/gal. Therefore, with customers having less incentive to steal, station owners did not place a high value on security.

With dispenser and site layouts today, an attendant may never know theft has begun or occurred. Even if the attendant is able to detect theft by observation, they may not know how long it has been since the theft took place or how many people got free fuel (and therefore, information about the theft may not be available). In some cases, surveillance video footage shows multiple people orchestrating fuel theft to fill multiple vehicles over an extended period of time. News media make the problem worse by increasing attention to the issue of fuel theft, and in some instances, clearly describing and illustrating what was done to steal fuel.

In addition to tampering with dispensers, fuel thieves drive over the underground tank covers with a van; remove the tank cover from inside the van, and pump fuel out of the underground tank and into a storage tank in their vehicle.

The present invention recognizes and addresses the foregoing considerations, and others, of prior art constructions and methods.

SUMMARY OF THE INVENTION

The present invention recognizes and addresses disadvantages of prior art constructions and methods, and it is an object of the present invention to provide an improved fuel dispenser comprising a shear valve coupled to a riser pipe that is in fluid communication with an underground storage tank, a primary flow meter in fluid communication with the shear valve and positioned down stream from the shear valve, a control system operatively coupled to the shear valve and the flow meter and an auxiliary flow detection device in fluid communication with the riser pipe and positioned at an entrance of the dispenser. The control system is operatively coupled to the auxiliary flow detection device, configured to compare a reading obtained from the primary flow meter to a reading obtained from the auxiliary flow detection device, and configured to produce a shutoff signal if the result is larger than a predetermined value.

In some embodiments, the auxiliary flow detection device is located in a housing of the shear valve. In some of these embodiments, the control system is operatively coupled to the shear valve and the shutoff signal causes the shear valve to close. In other embodiments, the accuracy of the primary flow meter is greater than the accuracy of the auxiliary flow detection device. In yet other embodiments, the auxiliary flow detection device comprises a flow meter.

In still other embodiments, an auxiliary shutoff system is operatively coupled to the control system, so that when the control system sends the shutoff signal, the auxiliary shutoff system prevents fuel from flowing to the primary flow meter. In some of these embodiments, the auxiliary flow detection device and the auxiliary shutoff system are enclosed in a housing, positioned at the entrance to the dispenser and in fluid communication with the riser pipe.

In yet other embodiments, a point-of-sale terminal is operatively coupled to the primary flow meter and the auxiliary flow detection device, wherein the point-of-sale terminal is configured to compare a reading from the primary flow meter to a reading from the auxiliary flow detection device and generate a shutoff signal if the difference between the readings is larger than a predetermined threshold value.

In another preferred embodiment, a fuel dispenser comprises a control system, a display operatively coupled to the control system, a card reader operatively coupled to the control system, a shear valve coupled to a riser pipe in fluid communication with an underground storage tank, a primary flow meter in fluid communication with the shear valve, operatively coupled to the control system and positioned downstream from the shear valve, an auxiliary flow detection device in fluid communication with the riser pipe, operatively coupled to the control system, an auxiliary shutoff system operatively coupled to the control system and positioned upstream from the primary flow meter, and a point-of-sale terminal located remote from the dispenser and operatively coupled to the control system. One of the control system and the point-of-sale terminal is configured to compare a reading obtained from the primary flow meter to a reading obtained from the auxiliary flow detection device, and configured to send a shutoff signal to the auxiliary shutoff system if the result of the comparison is larger than a predetermined threshold value.

In some embodiments, the auxiliary shutoff system is part of the shear valve. In some of these embodiments, the auxiliary flow detection device is integrally located in a housing of the shear valve. In yet other of these embodiments, the auxiliary flow detection device and the auxiliary shutoff system are within a single housing, and the single housing is positioned at an entrance of the dispenser. In still other of these embodiments, the single housing is positioned intermediate the shear valve and the primary flow meter. In other embodiments, the auxiliary flow detection device is a flow indicator.

In a preferred method of detection fuel theft at a fuel dispenser, the method comprises the steps of providing a dispenser having a primary flow meter, an auxiliary flow detection device positioned down stream from a riser pipe to which the dispenser is operatively coupled, and an auxiliary dispenser shutoff system, calculating a rate of flow through the primary flow meter, calculating a rate of flow through the auxiliary flow detection device, comparing the primary flow meter rate of flow to the auxiliary flow detection device rate of flow, and providing a shutoff signal to the auxiliary dispenser shutoff system to stop fuel flow through the dispenser.

In other embodiments, the shear valve further comprises an auxiliary dispenser shutoff system. In yet other embodiments, the method further comprises the step of taking a photo of an area surrounding the dispenser when the shutoff signal is provided. In still other embodiments, the auxiliary flow detection device and the auxiliary dispenser shutoff system are integrally formed in a single housing. In other embodiments, the method further comprises the step of recording all information regarding the comparison in a storage device in one of the dispenser control system or a point-of-sale terminal coupled to the dispenser control system. In still other embodiments, the method further comprises the step of manually restarting the dispenser.

The accompanying drawings, which are incorporated in and constitute a part of this specification, illustrate one or more embodiments of a theft detection and shut-off system of the present invention.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
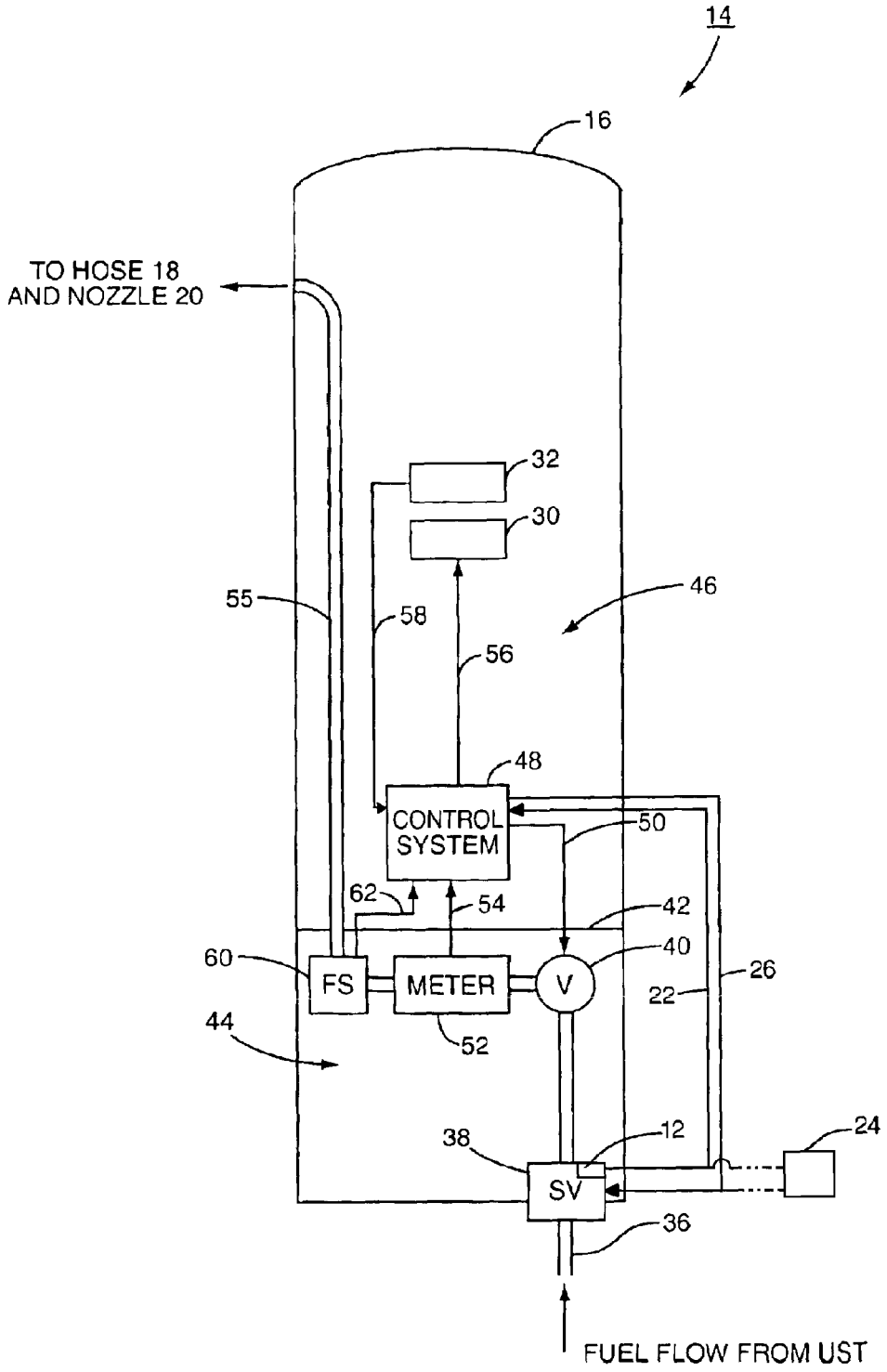
FIG. 1 is a schematic view of a fuel dispenser in accordance with one embodiment of the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention cover such modifications and variations. Additional aspects and advantages of the invention will be set forth in part in the description which follows and, in part, will be discerned from the description, or may be learned by practice of the invention.

Referring to FIG. 1, fuel from an underground storage tank (UST) is supplied to a fuel dispenser 14 via a fuel riser pipe 36. The fuel riser pipe is also referred to herein as "branch fuel piping." The fuel is pumped from a submersible turbine pump (STP) located in the UST into the main fuel piping located underneath the ground. The fuel is delivered to the individual fuel dispensers via the branch fuel piping 36 that is coupled to the main fuel piping using, for example, a T-style fitting connection. As fuel is delivered to fuel dispenser 14 via the main fuel piping and enters into branch fuel piping 36, the fuel enters into fuel dispenser 14 via a shear valve 38 that is in line with the branch fuel piping 36. Shear valve 38 is a device designed to close off the flow of fuel into the dispenser if the connection between the shear valve and the dispenser is broken, as would occur if a vehicle crashed into the dispenser. Shear valve 38 quickly shuts off the fuel flow so that a large amount of fuel cannot spray from the dispenser riser. Examples of shear valves in the prior art are disclosed in U.S. Pat. Nos. 5,527,130 and 7,555,935 and U.S. Published Pat. App. No. 2006/0260680, which are hereby incorporated herein by reference in its entirety.

In the present invention, shear valve 38 includes an auxiliary flow detection device in the form of an auxiliary flow detection device 12 that communicates with one or more of control system 48 and a remotely located point-of-sale (POS) terminal 24 over a communication line 22. Control system 48 and POS 24 are in communication with shear valve 38 via communication line 26 and can direct the shear valve to open or close, as described further below.

Figure 5:
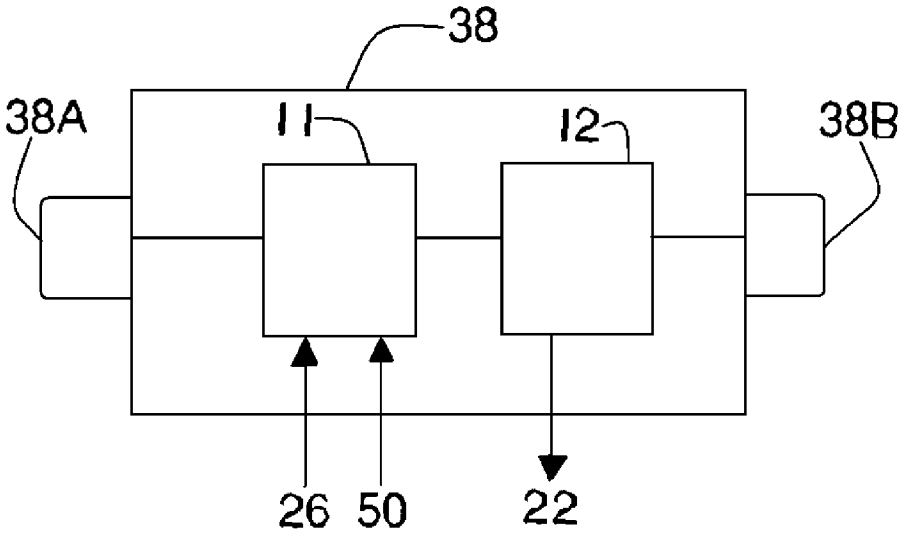
FIG. 5 is a diagrammatic view of a shear valve in accordance with one embodiment of the present invention for use in the dispenser shown in FIG. 1.

Referring to FIG. 5, a preferred embodiment of shear valve 38 has an input port 38A, an output port 38B, an auxiliary flow detection device 12 and an auxiliary shutoff device 11. Auxiliary shutoff device 11 may be a mechanical, electromechanical or other suitable valve configured to open and close based on input over lines 26 and 50. That is, in the case of a catastrophic event, auxiliary shutoff device 11 would automatically close preventing fuel from flowing through shear valve 38. During ordinary operation, auxiliary shutoff device 11 would remain open until input from control system 48 and/or POS 24 causes the auxiliary shutoff device to close in order to prevent fuel flow through shear valve 38. By reconfiguring shear valve 38 to include a resetable valve, the forecourt operator can manually reset auxiliary shutoff device 11. It should be understood that auxiliary flow detection device 12 may be a flow meter, a flow switch or any other suitable flow indicator.

Figure 2:
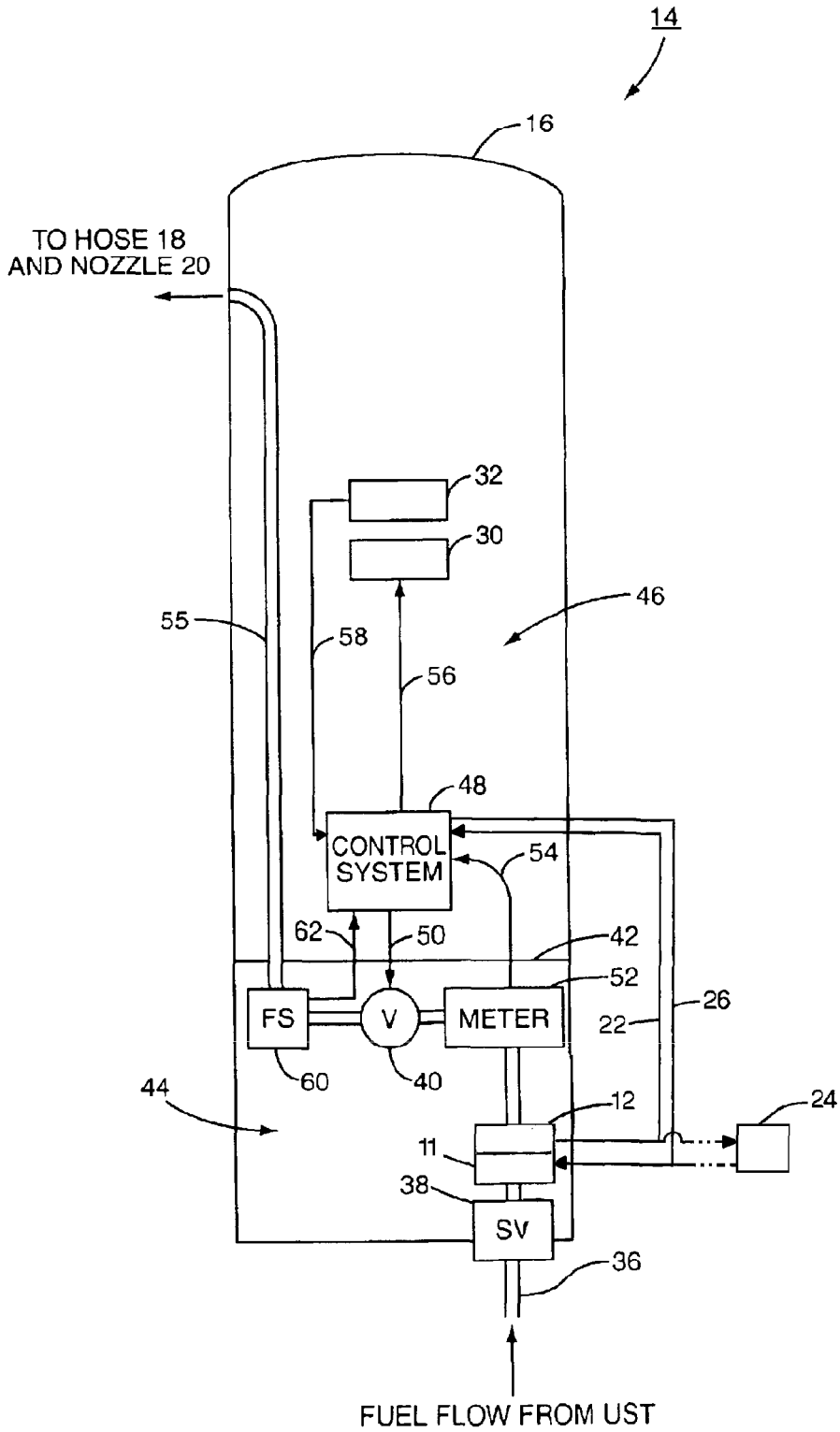
FIG. 2 is a schematic view of a fuel dispenser in accordance with one embodiment of the present invention.

A valve 40, which may be a proportional solenoid controlled valve, is positioned intermediate shear valve 38 and a flow meter 52. Alternatively, valve 40 may be positioned downstream of the flow meter 52 as shown in FIG. 2. Fuel flow meter 52 and valve 40 are located in a fuel handling compartment 44 of housing 16 that is isolated from electronic compartment 46 located above a vapor barrier 42. That is, in this configuration, fuel handling compartment 44 is isolated from any sparks or other events that may cause combustion of fuel vapors. In some embodiments, fuel handling compartment 44 may be located below ground. Flow meter 52 and valve 40 communicate with control system 48, which is in this case positioned in electronic compartment 46 as shown.

Control system 48 may be a microcontroller, a microprocessor, or other electronic systems with associated memory and software programs running thereon to control other aspects of the fuel dispenser 14, such as display 30, a card reader 32, etc. Control system 48 is configured to direct valve 40, via a valve communication line 50, to open and close when fuel dispensing is desired. If control system 48 directs valve 40 to open to allow fuel to flow, fuel enters valve 40 and exits into fuel flow meter 52.

The volumetric flow rate is measured by fuel flow meter 52, which is then communicated to the control system 48 via a pulser signal 54. More specifically, flow meter 52 converts mechanical motion (in this case, pistons inside the flow meter move with fluid flow and in turn rotate a flow meter output shaft) into electrical signals. An encoder (or pulser) is connected or coupled to the flow meter output shaft. Therefore, the rotating flow meter output shaft is detected, interpreted by the encoder and converted into electronic signals. In one preferred embodiment, flow meter 52 generates one thousand (1000) pulses per gallon of fuel dispensed and transmits pulser signal 54 to control system 48. Control system 48 updates the total gallons dispensed and the price of fuel dispensed on display 30 via a communication line 56. Payment may be effected on card reader 32, which communicates with control system 48 via communication line 58.

As fuel exits fuel flow meter 52, the fuel enters a flow switch 60, which generates a flow switch communication signal that is sent to control system 48 via a flow switch communication line 62. The flow switch communication signal indicates when fuel is flowing through fuel flow meter 52. The fuel flow exits flow switch 60 through a fuel conduit 55, which is in fluid communication with a hose 18 and nozzle 20 for eventual delivery. It should be understood that in the present invention, flow switch 60 is not necessary since auxiliary flow detection device 12 performs the same function as flow switch 60.

Referring to FIG. 2, fuel dispenser 14 is similar to that illustrated in FIG. 1, the major difference being that fuel flow meter 52 and valve 40 are rearranged and an auxiliary shutoff system 11 and an auxiliary flow detection device 12 are positioned downstream from shear valve 38. In this embodiment, after fuel exits shear valve 38, the fuel passes through auxiliary shutoff system 11 and auxiliary flow detection device 12 prior to entering fuel flow meter 52.

Downstream from flow meter 52 is valve 40. Control system 48 controls fuel flow by opening and closing valve 40. Flow switch 60 is located downstream of fuel flow meter 52 and valve 40 so that control system 48 has knowledge of when fuel flow is actually flowing through the dispenser. In alternate embodiments, flow switch 60 could also be located on the inlet side of fuel flow meter 52 either proximate to fuel flow meter 52 or before other components on the inlet side.

Auxiliary flow detection device 12 communicates with one or more of control system 48 and remotely located POS terminal 24 over a communication line 22. Control system 48 and POS 24 are operatively coupled to auxiliary shutoff system 11 via communication line 26 and can direct the auxiliary shutoff system to prevent fuel from flowing through dispenser 14. In this embodiment, auxiliary shutoff system 11 and an auxiliary flow detection device 12 may be separate components or may be located in a single housing that is positioned at the entrance of dispenser 14. As used herein, the "entrance" of the fuel dispenser is the location in the fuel flow path immediately upstream, downstream or at the location of the shear valve. These components may be located at the base of the dispenser or below ground level where they would be difficult to reach by a thief. In some embodiments, auxiliary shutoff system 11 and an auxiliary flow detection device 12 may be upstream from shear valve 38. Auxiliary flow detection device 12 may be a flow meter, flow indicator or any other suitable device for detecting the flow rate entering dispenser 10.

Figure 3:
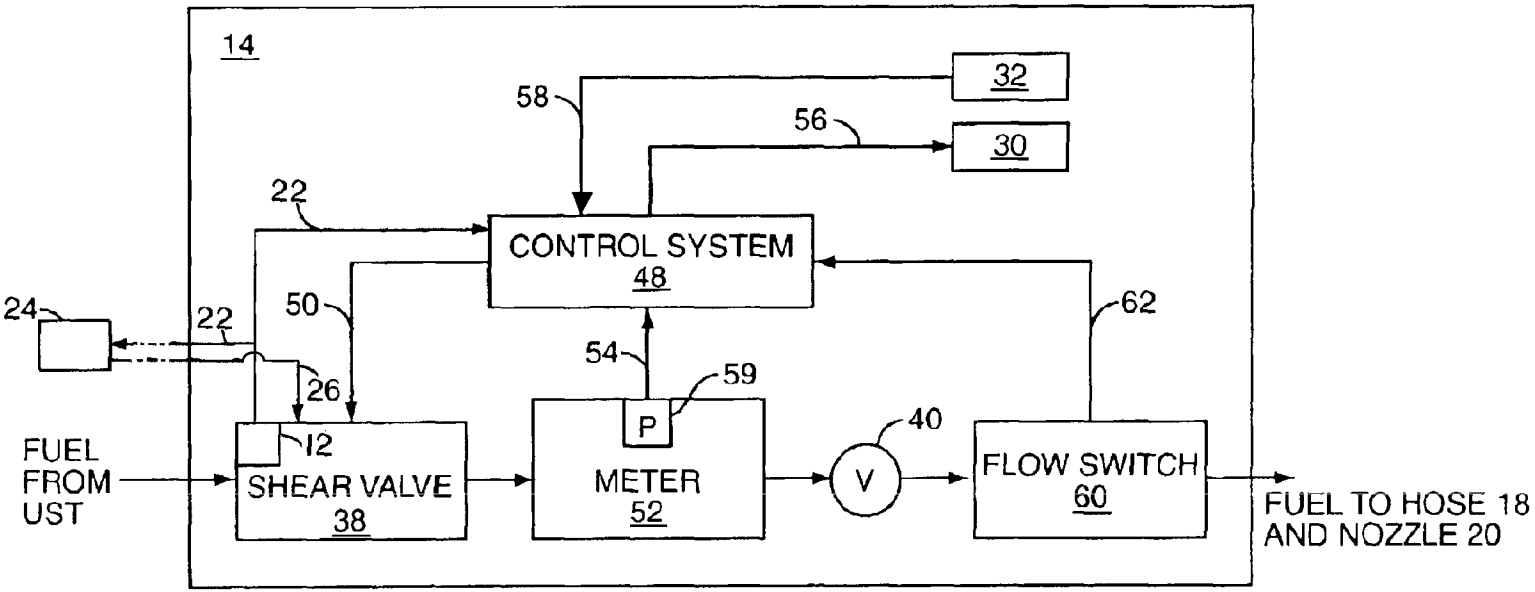
FIG. 3 is a schematic view of a fuel dispenser in accordance with one embodiment of the present invention.

Referring to FIG. 3, a dispenser 14 is shown having similar components to the dispensers illustrated in FIGS. 1-2. However, in this embodiment, control system 48 is in direct communication with shear valve 38 through communication line 50, with a flow meter pulser 59 through communication line 54 and with flow switch 60 via communication line 62. Flow switch 60 indicates when fuel is flowing through fuel flow meter 52. Based on signals from the flow switch, control system 48 can ignore any extraneous and erroneous pulser signals transmitted on communication line 54.

Pulser 59 generates pulser signals on communication line 54 and may be incorporated into fuel flow meter 52, or may be external to the fuel flow meter. Shear valve 38 includes an auxiliary flow meter 12 that measures the flow of fuel entering dispenser 14 from the underground storage tank. A signal indicative of the amount of fuel passing through the shear valve is communicated to control system 48 and/or POS 24 via line 22. Control system 48 is in communication with shear valve 38 via communication line 50, and POS 24 is in communication with shear valve 38 via communication line 26, and either can direct the shear valve to open or close.

The present invention advantageously provides an auxiliary flow detection device that may preferably be located at the base of the dispenser (at or below ground level) so that it cannot be bypassed in a typical theft scenario. Thus, in one preferred embodiment, the auxiliary flow detection device may be a flow meter located where riser pipe 36 connects to dispenser 14. In other preferred embodiments, the auxiliary flow detection device may be any type of flow indicator capable of determining whether fuel is passing through riser pipe 36. That is, flow rate or flow signal may be communicated to control system 48 and/or POS 24. In any of these embodiments, an auxiliary shutoff valve may be separate from, or incorporated into, shear valve 38, where the auxiliary shutoff valve may be controlled from one or both of the dispenser control system and the remote POS.

It should also be understood from the above that the auxiliary shutoff system 11 and the auxiliary flow detection device 12 may be located in various other locations in dispenser 10. For example, in some embodiments, auxiliary flow detection device 12 may be located at nozzle 20 or at the break-away where hose 18 connects to dispenser 10. Similar to auxiliary flow detection device 12, auxiliary shut-off system 11 may also be located at nozzle 20 or at the break-away where hose 18 connects to dispenser 10.

Figure 4:
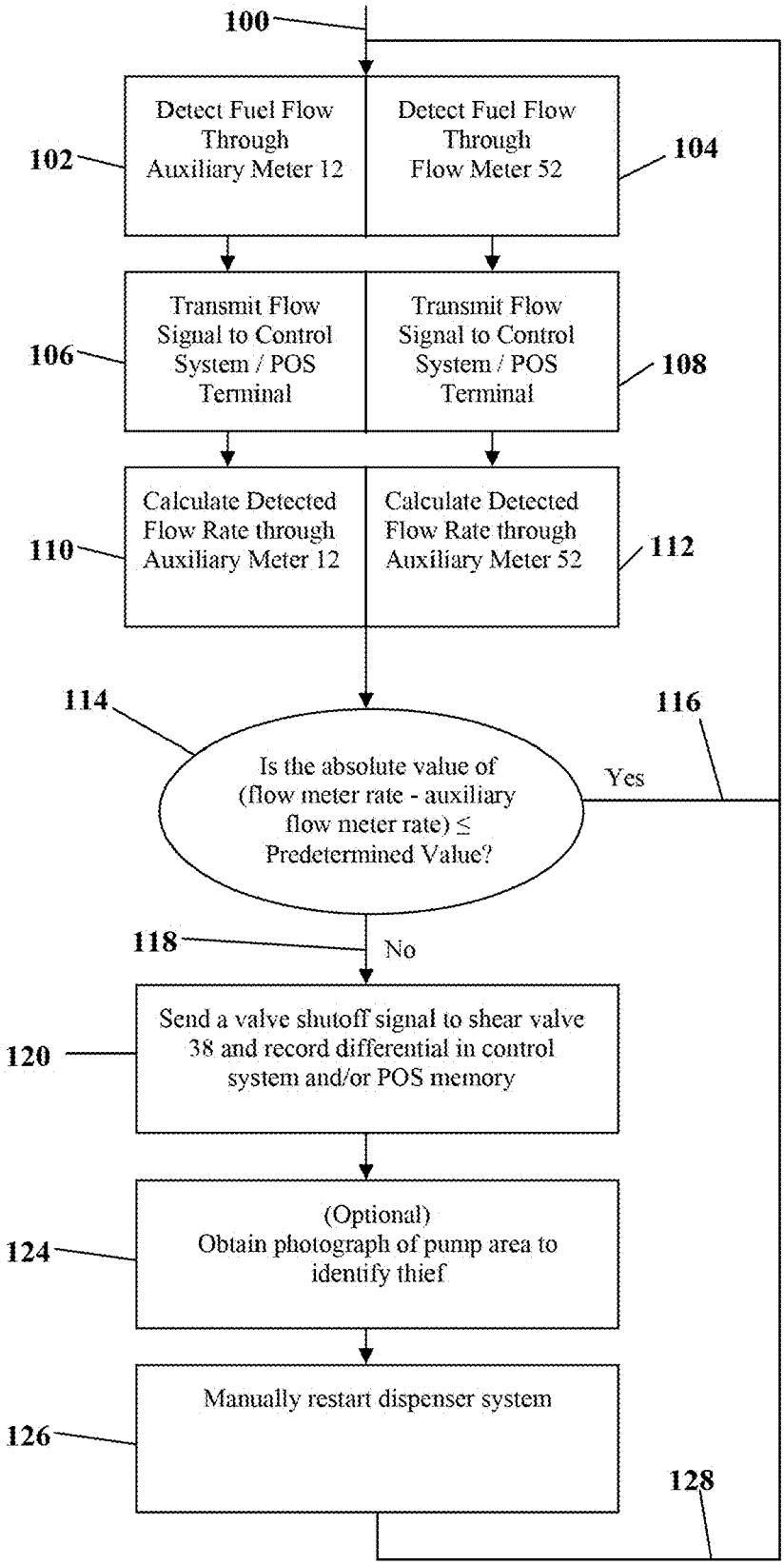
FIG. 4 is a flow diagram showing a fuel dispenser in any one of FIGS. 1-3 in accordance with an embodiment of the present invention.

In operation, and referring to FIG. 4, at step 100, a user places nozzle 20 into their fuel tank and begins a transaction at dispenser 14. A step 102, auxiliary flow detection device 12 detects the fuel flow into the dispenser through riser pipe 36, and at step 106, transmits a flow signal to control system 48 and/or POS terminal 24. Simultaneously, at step 104, flow meter 52 detects the fuel flow to nozzle 20, and at step 108, transmits a signal representative of that flow to control system 48 and/or POS 24. At steps 110 and 112, the respective flow rates of the auxiliary metering system and the primary metering system are calculated at control system 48 and/or POS 24, and at step 114, the calculated values are compared. Since the auxiliary metering system does not necessarily need to be as accurate as flow meter 52, the calculated values are compared in relation to a predetermined threshold value to accommodate for the different accuracies in the primary and auxiliary metering systems. At step 116, if the difference between the calculated values is less than the predetermined threshold value, the system returns to steps 102 and 104.

If, on the other hand, the difference between the calculated values exceeds the predetermined threshold value, at step 118, control system 48 and/or POS terminal 24 sends a shutoff signal to auxiliary shutoff system 11 and the differential is recorded as proof as to the amount of fuel that was stolen, at step 120. In addition to the differential amount, other information such as the time the discrepancy was detected, dispenser number and a photograph of the dispensing area (step 124) may also be included to help identify the thief and provide evidence to support any criminal charges. At step 126, dispenser 14 must be manually restarted to ensure that any additional theft is prevented. Once a manual restart is completed, at step 128, dispenser 14 is returned to step 100.

It should be understood that at step 124, additional alarms, both visual and audible may be included in the system to indicate when a theft has been detected. Such alarms may be instead of, or in addition to, obtaining a photograph. Moreover, in some instances, a direct comparison of the flow rate detected at flow meter 52 and at auxiliary flow detector 12 may be compared to determine whether a theft is occurring. In addition to alarms, the system may be configured to send an e-mail regarding the incident, phone authorities and/or send a text message to designated employees.

Another benefit of the above described invention is that leaks may be detected. That is, if auxiliary flow detection device 12 detects fluid flow when dispenser 14 is not engaged in a transaction, control system 48 may be programmed to provide a shutdown command to auxiliary shutoff system 12 to minimize any leak. Similar to the flow diagram show in FIG. 4, flow is detected at the auxiliary flow detection device and compared to a flow reading at the primary flow meter. In the case of a leak, there would be no flow at the primary flow meter. The two readings are compared and the difference is above a threshold value, a leak is detected. A shutoff signal is sent to the auxiliary shutoff system to prevent fuel from passing through the dispenser and a warning signal may be transmitted to the proper parties. Thus, in addition to providing theft protection, the system of the present invention also detects and minimizes any leaks that may occur.

The present invention may also be used in pumping units (not shown). Pumping units have a pump located in the dispenser and when a transaction begins, the suction pump draws fluid out of the underground storage tank and pumps it into the car or storage tank. With a pumping unit, when a theft is detected, control system 48 is configured to provide a shutoff signal to the suction pump thereby preventing any additional fuel from being pumped from the underground storage tank.

While one or more preferred embodiments of the invention are described above, it should be appreciated by those skilled in the art that various modifications and variations can be made in the present invention without departing from the scope and spirit thereof. It is intended that the present invention cover such modifications and variations as come within the scope and spirit of the appended claims and their equivalents.

What is claimed:

1. A fuel dispenser comprising:

a. a shear valve coupled to a riser pipe in fluid communication with an underground storage tank, the riser pipe comprising branch fuel piping;

b. a primary flow meter in fluid communication with said shear valve and positioned down stream from said shear valve;

c. a control system operatively coupled to said shear valve and said flow meter; and d. an auxiliary flow detection device in fluid communication with said riser pipe and positioned at an entrance of the dispenser such that the auxiliary flow detection device is disposed proximate to the shear valve, is positioned upstream from the primary flow meter, and is coupled to the branch fuel piping, wherein said control system is operatively coupled to said auxiliary flow detection device, configured to perform a comparison of a reading obtained from said primary flow meter to a reading obtained from said auxiliary flow detection device, and configured to produce a shutoff signal if a result of said comparison is larger than a predetermined value.

2. The fuel dispenser of claim 1, wherein said auxiliary flow detection device is located in a housing of said shear valve.

3. The fuel dispenser of claim 2, wherein said control system is operatively coupled to said shear valve and said shutoff signal causes said shear valve to close.

4. The fuel dispenser of claim 1, wherein the accuracy of said primary flow meter is greater than the accuracy of said auxiliary flow detection device.

5. The fuel dispenser of claim 1, said auxiliary flow detection device comprises a flow meter.

6. The fuel dispenser of claim 1, further comprising an auxiliary shutoff system operatively coupled to said control system, so that when said control system sends said shutoff signal, said auxiliary shutoff system prevents fuel from flowing to said primary flow meter.

7. The fuel dispenser of claim 6, wherein said auxiliary flow detection device and said auxiliary shutoff system are enclosed in a housing, positioned at said entrance to the dispenser and in fluid communication with said riser pipe.

8. The fuel dispenser of claim 1, further comprising a point-of-sale terminal operatively coupled to said primary flow meter and said auxiliary flow detection device, wherein said point-of-sale terminal is configured to compare a reading from said primary flow meter to a reading from said auxiliary flow detection device and generate a shutoff signal if the difference between said readings is larger than a predetermined threshold value.

9. A fuel dispenser comprising:

a. a control system;

b. a display operatively coupled to said control system;

c. a card reader operatively coupled to said control system;

d. a shear valve coupled to a riser pipe in fluid communication with an underground storage tank, the riser pipe comprising branch fuel piping;

e. a primary flow meter in fluid communication with said shear valve, operatively coupled to said control system and positioned downstream from said shear valve;

f. an auxiliary flow detection device in fluid communication with said riser pipe and positioned at an entrance of said fuel dispenser such that the auxiliary flow detection device is disposed proximate to the shear valve, is positioned upstream from the primary flow meter, and is coupled to the branch fuel piping, said auxiliary flow detection device operatively coupled to said control system;

g. an auxiliary shutoff system operatively coupled to said control system and positioned upstream from said primary flow meter; and h. a point-of-sale terminal located remote from said dispenser and operatively coupled to said control system;

wherein one of said control system and said point-of-sale terminal is configured to compare a reading obtained from said primary flow meter to a reading obtained from said auxiliary flow detection device, and configured to send a shutoff signal to said auxiliary shutoff system if the result of the comparison is larger than a predetermined threshold value.

10. The dispenser of claim 9, wherein said auxiliary shutoff system is part of said shear valve.

11. The dispenser of claim 10, wherein said auxiliary flow detection device is located in a housing of said shear valve.

12. The dispenser of claim 9, wherein a. said auxiliary flow detection device and said auxiliary shutoff system are within a single housing, and b. said single housing is positioned at an entrance of the dispenser.

13. The dispenser of claim 12, wherein said single housing is positioned intermediate said shear valve and said primary flow meter.

14. The dispenser of claim 9, wherein said auxiliary flow detection device is a flow indicator.

15. A method of detecting fuel theft at a fuel dispenser, the method comprising:

a. providing a dispenser having (i) a primary flow meter, (ii) an auxiliary flow detection device positioned at an entrance of said dispenser in fluid communication with a riser pipe comprising branch fuel piping to which said dispenser is operatively coupled such that the auxiliary flow detection device is disposed proximate to the shear valve, is positioned upstream from the primary flow meter, and is coupled to the branch fuel piping, and (iii) an auxiliary dispenser shutoff system;

b. calculating a rate of flow through said primary flow meter;

c. calculating a rate of flow through said auxiliary flow detection device;

d. comparing said primary flow meter rate of flow to said auxiliary flow detection device rate of flow; and e. providing a shutoff signal to said auxiliary dispenser shutoff system to stop fuel flow through said dispenser.

16. The method of detecting fuel theft of claim 15, further comprising providing a shear valve coupled to said riser pipe, wherein said shear valve further comprises said auxiliary shutoff system.

17. The method of detecting fuel theft of claim 15, further comprising the step of taking a photo of an area surrounding said dispenser when said shutoff signal is provided.

18. The method of detecting fuel theft of claim 15, wherein said auxiliary flow detection device and said auxiliary dispenser shutoff system are integrally formed in a single housing.

19. The method of detecting fuel theft of claim 15, further comprising the step of recording all information regarding the comparison in a storage device in one of a dispenser control system or a point-of-sale terminal coupled to said dispenser control system.

20. The method of detecting fuel theft of claim 15, further comprising the step of manually restarting said dispenser.

21. The fuel dispenser of claim 1, wherein the control system is located in a housing of said fuel dispenser.

22. The fuel dispenser of claim 9, wherein the control system is located in a housing of said fuel dispenser.

* * * * *

UNITED STATES PATENT AND TRADEMARK OFFICE

CERTIFICATE OF CORRECTION

PATENT NO. : 8,376,185 B2
APPLICATION NO. : 12/536187
DATED : February 19, 2013
INVENTOR(S) : Liebal et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 625 days.

Signed and Sealed this
Twenty-fifth Day of November, 2014

Michelle K. Lee

Michelle K. Lee
*Deputy Director of the United States Patent and Trademark Office*